US005516259A

United States Patent [19]

Niederkofler et al.

[11] Patent Number: 5,516,259

[45] Date of Patent: May 14, 1996

[54] AGGREGATE FOR FEEDING FUEL FROM SUPPLY TANK TO INTERNAL COMBUSTION ENGINE OF MOTOR VEHICLE

[75] Inventors: Michael Niederkofler, Affalterbach; Willi Strohl, Beilstein; Jochen Rose, Hemmingen, all of Germany

[73] Assignee: Robert Bosch GmbH, Stuttgart, Germany

[21] Appl. No.: 388,738

[22] Filed: Feb. 15, 1995

[30] Foreign Application Priority Data

Apr. 2, 1994 [DE] Germany ..... 44 11 627.6

[51] Int. Cl.[6] ..... F01D 3/00

[52] U.S. Cl. ..... 415/55.1; 415/55.5

[58] Field of Search ..... 415/55.1, 55.5, 415/55.6

[56] References Cited

U.S. PATENT DOCUMENTS

| | | | |
|---|---|---|---|
| 4,854,830 | 8/1989 | Kozawa et al. . | |
| 4,923,365 | 5/1990 | Rolwage | 415/55.1 |
| 5,328,325 | 7/1994 | Strohl et al. | 415/55.1 |
| 5,378,125 | 1/1995 | Frank et al. | 415/55.1 |
| 5,409,357 | 4/1995 | Yu et al. | 415/55.1 |
| 5,415,521 | 5/1995 | Hufnagel et al. | 415/55.1 |

*Primary Examiner*—John T. Kwon
*Attorney, Agent, or Firm*—Michael J. Striker

[57] ABSTRACT

Aggregate for feeding fuel from a supply tank to an internal combustion engine of a motor vehicle has a feeding pump formed as a flow pump and including a disc-shaped rotatable impeller. A hydraulic buffer is formed between the impeller and the end walls of the pump chamber and includes recesses provided in a structure selected from the axial end surface of the impeller and the end walls of the pump chamber, so that the recesses are fillable with fuel during operation of the feeding pump and form the hydraulic buffer which acts in an axial direction of the impeller and stabilizes the impeller. An outer ring which connects the vanes of the impeller at their radially outer ends and limits the impeller in a peripheral direction. The recesses are arranged in a region of the outer ring.

16 Claims, 3 Drawing Sheets

FIG. 1
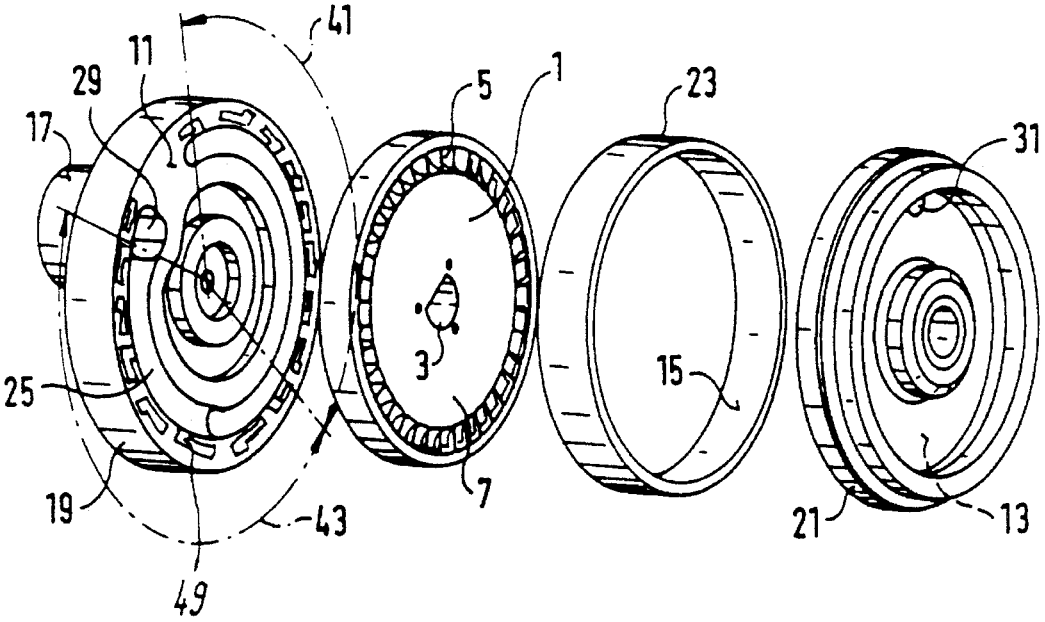
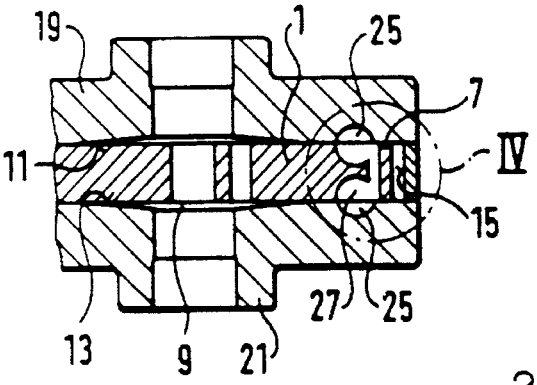
FIG. 2
FIG. 3A
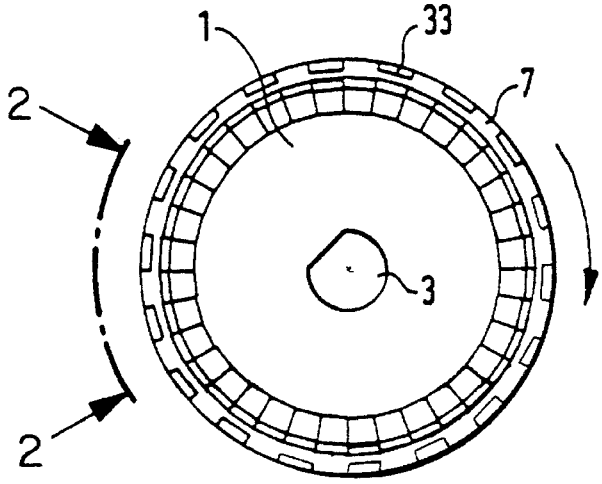

AGGREGATE FOR FEEDING FUEL FROM SUPPLY TANK TO INTERNAL COMBUSTION ENGINE OF MOTOR VEHICLE

BACKGROUND OF THE INVENTION

The present invention relates to an aggregate for feeding a fuel from a supply tank to an internal combustion engine of a motor vehicle.

One of such aggregates is disclosed for example in U.S. Pat. No. 4,854,830. The feeding aggregate disclosed in this reference has an electric drive motor which rotates an impeller of a feeding pump formed as a flow pump. The disc-shaped impeller is provided on its periphery with a plurality of radially outwardly extending vanes and rotates in a cylindrical pump chamber limited in an axial direction of the impeller by two opposite end walls and in a radial direction by a ring wall. A partially ring-shaped groove extending around the rotary axis of the impeller is provided in the axial end walls of the pump chamber at the height of the vanes and forms with the impeller a feeding passage. The feeding passage extends from an inlet opening in the pump chamber at its one end to an outlet opening at its another end. During the rotary movement of the impeller fuel is aspirated into the pump chamber through the inlet opening and discharged with increased pressure through the outlet opening.

The known aggregate is provided with recesses in the axial end walls of the impeller for avoiding an increased wear and a high noise generation due to inclination of the impeller and a wall contact caused by asymmetrical pressure forces resulting from a very narrow axial gap between the impeller and the end walls of the pump chamber. During the rotary movement of the impeller the recesses are filled with fuel so that a hydraulic buffer is provided between the impeller and the axial walls of the pump chamber.

While the recesses in the known feeding aggregate can be designed in different ways, they are always limited by their location in the axial end faces of the impeller. This has however the disadvantage that the hydraulic buffer is limited to the region arranged radially inwardly of the feeding passage. The axial pressure forces act however at the height of the feeding passage on the impeller and can generate, due to the great distance from the impeller axis (lever action) relative to the hydraulic buffer, great resulting forces. Therefore the formation of the hydraulic buffer in the known feeding aggregate does not reliably eliminate the inclined positions of the impeller.

SUMMARY OF THE INVENTION

Accordingly, it is an object of the present invention to provide a feeding aggregate of the above mentioned general type, which avoids the disadvantages of the prior art.

In keeping with these objects and with others which will become apparent hereinafter, one feature of the present invention resides, briefly stated, in a feeding aggregate, in which in accordance with the present invention an outer ring connects the vanes of the impeller and their radially outer ends and limits the impeller in a peripheral direction, and the depressions are arranged in the region of the outer ring.

Because of the arrangement of the recesses in a region located outside of the feeding passage, the hydraulic buffer is formed radially outside of the feeding passage, and therefore a great resulting axial force and a greater restoring moment on the impeller is formed over its greater distance from the impeller axis. The axial force acting on the outer ring which is arranged radially outside of the feeding passage and surrounds the impeller, therefore acts radially inwardly of the feeding passage and provides a reliable elimination of an inclined position of the impeller as a result its contact with one of the end walls of the pump chamber. The filling of the recesses on the outer ring in addition to the pressure conditions in the feeding passage also is guaranteed by the centrifugal action of the rotating fuel in the pump chamber.

In an advantageous member manner, it is possible to arrange the recesses in the impeller as well as in the end walls of the pump chamber.

The recesses can be formed preferably as symmetrical troughs to provide a design which is independent from the rotary direction.

In order to obtain a reliable filling of the recesses, it is also advantageous to form them inclined. The ends of the recesses can be offset opposite to the rotary direction of the impeller in the peripheral surface of the outer ring or in the region of the ends opening of the feeding passage. In addition, the recesses can be provided in their inclined region with a ramp-like cross-sectional increase extending to their ends which face in the rotary direction of the impeller.

The inclined recesses can be arranged radially inwardly from the peripheral surface and also radially outwardly from the region of the feeding passage. It is possible to provide only one of these shapes or both shapes alternatingly for a reliable stabilization of the impeller, which is especially place-economical.

In accordance with a further embodiment of the invention, the recesses can be provided by an angled shape, which makes possible both a reliable filling and an optical pressure formation in the recesses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an exploded view of a flow pump of a feeding aggregate in accordance with the present invention, with recesses arranged in end walls of the pump chamber;

FIG. 2 is a view showing a cross-section of the flow pump of the inventive aggregate;

FIGS. 3A–3E are views showing an impeller of the flow pump with an outer ring with recesses having different shapes;

DESCRIPTION OF THE PREFERRED EMBODIMENTS

Figure 3B:
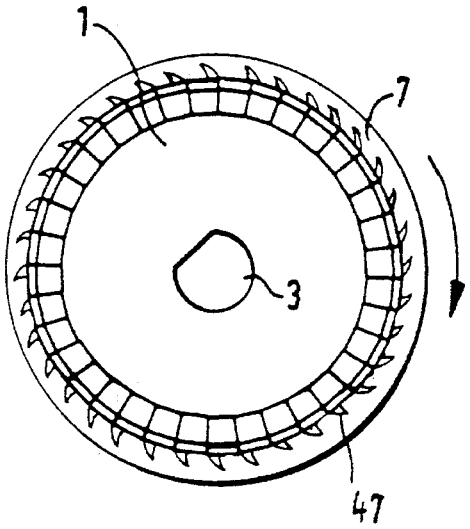

An aggregate for feeding fuel from a fuel supply tank to an internal combustion engine of a motor vehicle has a not shown electric motor with a rotor shaft for rotating an impeller 1 of a feeding pump which is formed as a flow pump. The disc-shaped impeller 1 has a central, profiled opening 3 for connection with the rotor shaft, and a plurality of radially outwardly extending vanes on its periphery. An outer ring 17 connects radially outer ends of the vanes 5 and peripherally surrounds the impeller 1.

The impeller 1 is arranged in a cylindrical pump chamber 9 which is shown in FIG. 2. The pump chamber is limited in an axial direction of the impeller 1 by two opposite end walls 11 and 13, and in a peripheral direction of the impeller by a ring wall 15. As can be seen from FIG. 1, the first end wall 11 of the pump chamber 9 is arranged on a suction cover 19 of the feeding pump which suction cover is provided with a suction pipe 17. The second end wall 13 is arranged on a discharge cover 21 which limits the feeding pump in direction of the electric drive motor. The ring wall 15 is formed as an inner wall of a spacer ring 23 which is clamped between the suction cover 19 and discharge cover 21 and determines the distance between the covers. The spacer ring 23 has a size provided for adjusting an axial gap between the impeller 1 and the end walls 11, 13. The spacer ring 23 can be also a part of the suction cover 19 or the discharge cover 21.

Grooves 25 are provided in the end walls 11 and 13 at the height of the vanes 5 of the impeller 1. They are located opposite to one another, have a partial-ring shape and extend around the rotary axis of the impeller 1. Together with the impeller 1, the grooves 25 form a feeding passage 27. The feeding passage leads in a known manner from an inlet opening 29 connected with the suction pipe 17 and provided in the suction cover 19, to an outlet opening 31 provided in the discharge cover 21. For an axial stabilization of the impeller 1 during the operation of the feeding pump, in addition recesses are arranged in the outer ring 17 or in the end sides 11, 13 of the pump chamber 9 as shown in FIGS. 3A–6. The recesses are uniformly distributed over the periphery of the outer ring 7 or the pump chamber 9. As shown in FIG. 3A. In the region oriented in the peripheral direction of the impeller 1, the recesses can be formed as angled recesses 49 open in a region oriented radially toward the impeller axis. In the region oriented in the peripheral direction of the impeller 1, the recesses can be formed as angled recesses 49 extending opposite to the rotary direction of the impeller 1 and having a cross-section increasing in direction of the radial region. The radial region can be oriented both radially inwardly and also radially outwardly, or alternatingly radially inwardly and radially outwardly. This is shown in FIGS. 3D and 3E.

Figure 3C:
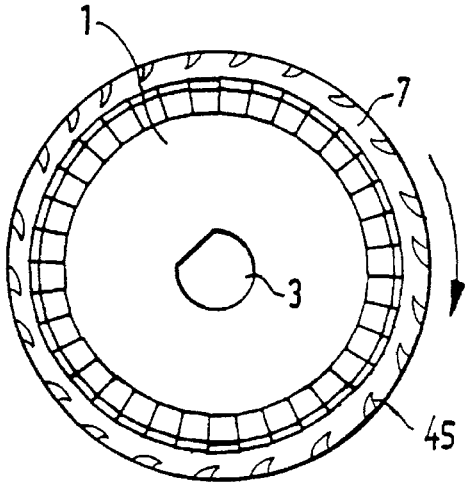
Figure 3D:
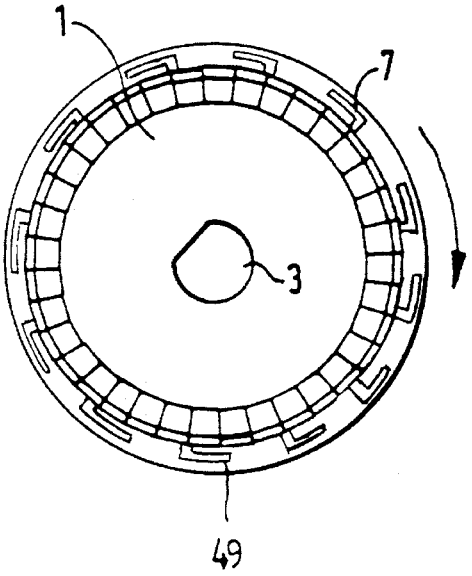
Figure 3E:
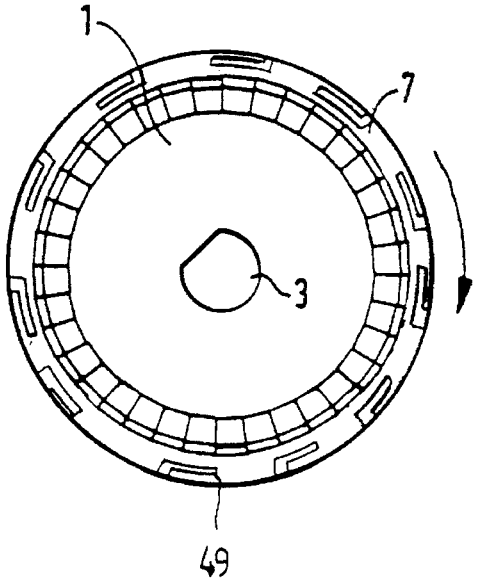
Figure 4:
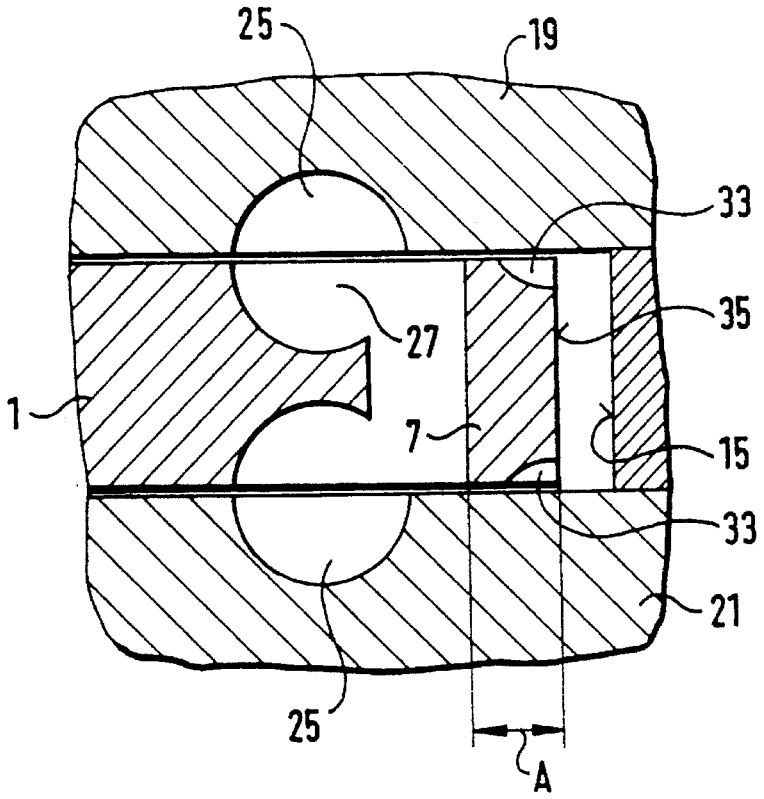
FIG. 4 is a view showing an enlarged portion of FIG. 2 with an axial section of the impeller with the recesses.

The recesses 33 in the outer ring 7 of the impeller 1 shown in FIGS. 3A–6 extend from the radially outer peripheral surface 35 of the outer ring 7 or from the feeding passage 27 to substantially half width A of the outer ring. The course of the surface of the recesses 33 formed in the end side of the outer ring 7 is curved as shown in FIG. 4.

The recesses can be symmetrical as shown in FIG. 3A or also can be inclined. The radially outwardly oriented inclined recesses 45 and the radially inwardly oriented recesses 47 shown in FIGS. 3C and 3B are directed so that their inclined ends are oriented opposite to the rotary direction of the impeller 1. This contributes to their filling with fuel during the operation of the feeding pump. Only radially inwardly directed recesses or only radially outwardly directed recesses can be provided. However, it is possible to provide both types of recesses and arrange them in alternating order. The cross-section of the recess 33 continuously increases in direction toward the outlet opening.

In the embodiment of the recesses with the angled shape shown in FIGS. 3D and 3E, the radial ends of the angled recesses 49 can open correspondingly in the peripheral surface 35 or the feeding passage 27.

Figure 5:
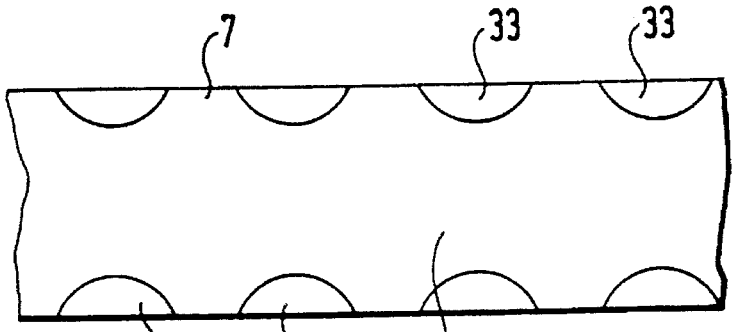
FIGS. 5 and 6 show an enlarged view of an outer peripheral surface of the outer ring with the recesses.
Figure 6:
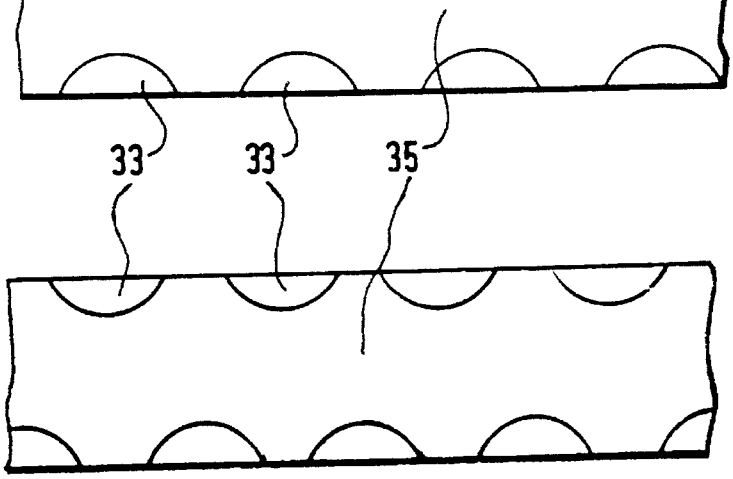

The outlet openings of the recesses 33 shown in FIGS. 5 and 6 can be arranged on the peripheral surface 35 of the outer ring 7 both opposite to one another or also offset relative to one another. In the shown embodiment they have a symmetrical shape.

The inventive feeding aggregate operates in the following manner: The impeller 1 rotatably driven by the electric drive motor aspirates fuel through the suction pipe 17 in the inlet opening 29 from the supply tank into the feeding passage 27. There the pressure of the fuel increases during its flowing in direction toward the outlet opening 31 because of the pulse exchange between the fuel accelerated in the impeller 1 and the fuel flowing in the feeding passage 27. The fuel flows through the outlet opening 31 with the increased pressure into the housing of the feeding aggregate which accommodates the feeding pump and the drive motor, and then flows there to a not shown pressure connection connected with a feeding conduit to the internal combustion engine. During the fuel feeding a leakage quantity is discharged through the axial gap between the impeller 1 and the end walls 11, 13 of the pump chamber 9 from the feeding passage 27. The leakage flow occurs on the high pressure side 41 (FIG. 1) of the feeding passage 27. In other words, the leakage quantity extends from a central region of the feeding passage to the outlet opening 31 of the feeding passage 27 in the axial gap, and from there through the recesses 33 on the outer ring 7 or in the end walls 11, 13 in a ring chamber between the same and the ring wall 15, and then at the low pressure side 43 flows in an opposite direction into the feeding passage 27. Therefore the recesses 35 are always reliably filled with fuel, which leads to formation of a hydraulic pressure wedge or buffer provided between the impeller 1 and the end walls 11, 13 and acting on the impeller 1 axially. Due to the uniform arrangement of the recesses 33, the impeller 1 is centered in a manner of a hydrodynamic axial bearing.

With the feeding aggregate designed in accordance with the present invention it is possible, in a simple structural manner, to avoid reliably the axial movement of the impeller toward the end walls of the pump chamber because of an inclined position of the impeller, and the application of the supporting and centering axial force at the outer periphery of the impeller is especially efficient.

It will be understood that each of the elements described above, or two or more together, may also find a useful application in other types of constructions differing from the types described above.

While the invention has been illustrated and described as embodied in an aggregate for feeding fuel from supply tank to internal combustion engine of motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and a circumferentially closed outer ring which connects said vanes of said impeller at their radially outer ends and limits said impeller in a peripheral direction, wherein said recesses being arranged in a region of said outer ring and being radially offset from said partial ring-shaped groove.

2. An aggregate as defined in claim 1, wherein said recesses are arranged in said outer ring.

3. An aggregate as defined in claim 1, wherein said recesses are arranged radially outside of said feeding passage in said end walls of said pump chamber.

4. An aggregate as defined in claim 1, wherein said recesses are formed as symmetrical trough-shaped notches with a cross-section which reduces in a wedge-shaped manner in a peripheral direction.

5. An aggregate as defined in claim 4, wherein said recesses in a radial direction extend toward said outer ring from its radially outer peripheral surface so as to form a curved surface.

6. An aggregate as defined in claim 5, wherein said recesses extend over a half width of said outer ring.

7. An aggregate as defined in claim 5, wherein said recesses have an edge which opens into said outer peripheral surface of said ring and is circular segment-shaped.

8. An aggregate as defined in claim 1, wherein said recesses are uniformly distributed over a periphery of said impeller.

9. An aggregate as defined in claim 1, wherein said recesses are uniformly distributed over a periphery of said pump chamber.

10. An aggregate as defined in claim 1, wherein said outer ring has opposite end sides provided with said depressions, said depressions on said opposite sides of said outer ring being offset in a peripheral direction of said outer ring relative to one another.

11. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and an outer ring which connects said vanes of said impeller at their radially outer ends and limits said impeller in a peripheral direction, wherein said recesses being arranged in a region of said outer ring, said recesses being inclined relative to a radial plane of said impeller and opposite to a rotary direction of said impeller.

12. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and an outer ring which connects said vanes of said impeller at their radially outer ends and limits said impeller in a peripheral direction, wherein said recesses being arranged in a region of said outer ring, said recesses being inclined relative to a radial plane of said impeller and opposite to a rotary direction of said impeller, said recesses being formed as inclined recesses extending radially outwardly in a peripheral surface of said outer ring.

13. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and an outer ring which connects said vanes of said impeller at their radially outer ends and limits said impeller in a peripheral direction, wherein said recesses being arranged in a region of said outer ring, said recesses being inclined relative to a radial plane of said impeller and opposite to a rotary direction of said impeller, said recesses being formed as inclined recesses extending radially inwardly in a region of said feeding passage.

14. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and an outer ring which connects said vanes of said impeller at their radially outer ends and limits said impeller in a peripheral direction, wherein said recesses being arranged in a region of said outer ring, said recesses being inclined relative to a radial plane of said impeller and opposite to a rotary direction of said impeller, said inclined recesses including recesses which extend radially outwardly in a peripheral direction of said outer ring and radially inwardly in a region of said feeding passage, said radially inwardly extending recesses and said radially outwardly extending recesses being distributed alternatingly.

15. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and an outer ring which connects said vanes of said impeller at their radially outer ends and limits said impeller in a peripheral direction, wherein said recesses being arranged in a region of said outer ring, said recesses being inclined relative to a radial plane of said impeller and opposite to a rotary direction of said impeller, said inclined recesses having a cross-section which increases in a rotary direction of said impeller.

16. Aggregate for feeding fuel from a supply tank to an internal combustion engine of a motor vehicle, comprising a feeding pump formed as a flow pump and including a disc-shaped rotatable impeller having an axis, axial end faces, and a plurality of radially extending vanes; means forming a cylindrical pump chamber and including two oppositely located end walls limiting said pump chamber in an axial direction of said impeller and a ring wall limiting said pump chamber in a peripheral direction of said impeller; means forming an inlet opening and an outlet opening, said end walls each having a partial ring shaped groove extending around said axis of said impeller at a height of said vanes of said impeller and forming together with said impeller a feeding passage, said feeding passage extending from said inlet opening to said outlet opening; means forming a hydraulic buffer between said impeller and said end walls of said pump chamber and including recesses provided in a structure selected from said axial end faces of said impeller and said end walls of said pump chamber, so that said recesses are fillable with fuel during operation of said feeding pump and form said hydraulic buffer which acts in an axial direction of said impeller and stabilizes said impeller; and an outer ring which connects said vanes of said impeller at their radially outer ends and limits said impeller in a peripheral direction, wherein said recesses being arranged in a region of said outer ring, said recesses being formed as angled recesses with a first region directed radially toward said impeller and a second region leading away from said first region opposite to a rotary direction of said impeller and in a peripheral direction of said impeller.

* * * * *